United States Patent [19]

Harbom

[11] Patent Number: 4,852,312

[45] Date of Patent: Aug. 1, 1989

[54] WINDOW FRAME ASSEMBLY

[75] Inventor: John Harbom, Bolton, Canada

[73] Assignee: Plastmo Ltd., Brampton, Canada

[21] Appl. No.: 289,097

[22] Filed: Dec. 23, 1988

[51] Int. Cl.[4] ..... E04B 2/82

[52] U.S. Cl. ..... 52/126.3; 52/204; 52/209; 52/397; 49/DIG. 2

[58] Field of Search ..... 52/208, 209, 217, 397, 52/126.3, 126.5, 207, 204; 49/DIG. 2

[56] References Cited

U.S. PATENT DOCUMENTS

| | | | |
|---|---|---|---|
| 2,300,485 | 11/1942 | Bristow | 52/126.3 X |
| 2,612,663 | 10/1952 | Pearse | 52/126.3 |
| 3,703,063 | 11/1972 | Budich et al. | 52/204 X |
| 4,420,919 | 12/1983 | Weber | 52/204 |

*Primary Examiner*—Carl D. Friedman
*Assistant Examiner*—Creighton Smith
*Attorney, Agent, or Firm*—Robert F. Delbridge; Arne L. Fors

[57] ABSTRACT

A window frame assembly includes a frame member having a longitudinally extending channel with a bottom surface and front and rear walls. Each wall has a longitudinally extending recess adjacent to the bottom surface. The window frame assembly also has a plurality of support members for a window unit, the support members being longitudinally spaced along the channel. Each support member rests on the bottom surface of the channel and has front and rear longitudinally extending projections in snapping engagement in the recesses in the front and rear walls of the channel.

5 Claims, 3 Drawing Sheets

WINDOW FRAME ASSEMBLY

Figure 1:
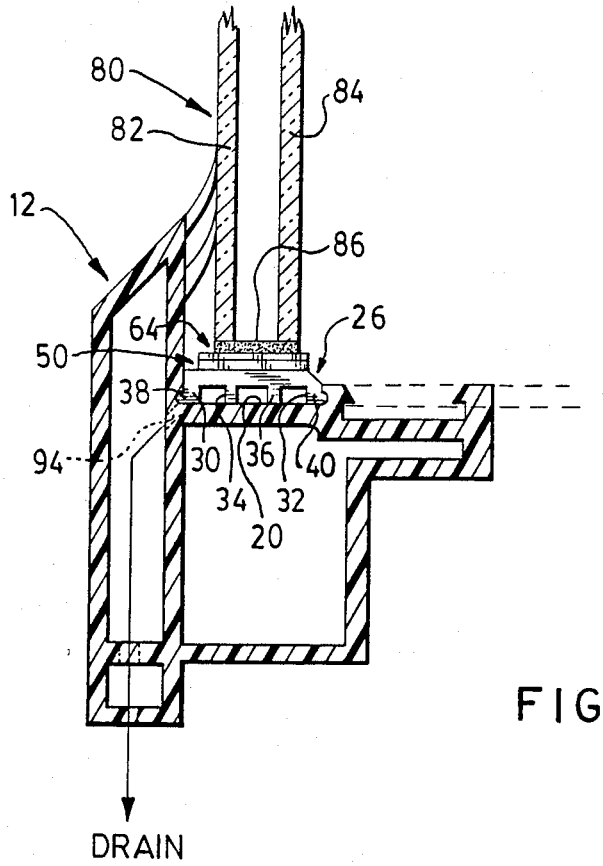

This invention relates to window frame assemblies.

Present day window frame assemblies frequently include frame members which support a sealed window unit, for example a thermopanel. The window unit rests on support members (known as glazing blocks) which are positioned at spaced intervals along a channel in the lower frame member, with one or more plate-like shims (known as glazing packers) being positioned if necessary between the support members and the window unit to locate the window unit at the desired height in the window frame. Similar arrangements are used to correctly position and secure the window unit with respect to the side frame members and upper frame member. In the prior art, the support members are secured in place in the channels in the frame members by a suitable sealing adhesive, such as silicone sealant. The lower frame member usually has drain holes extending from the channel so that moisture running down into the channel from the window panes can drain away.

With the above known arrangement however, the requirement that the support members be secured in place by adhesive is time-consuming. If adhesive is not used, the plate-like shims tend not to remain in their proper positions.

It is therefore an object of the present invention to provide an improved window frame assembly which does not have the problems mentioned above.

According to the present invention, a window frame assembly includes a frame member having a longitudinally extending channel with a bottom surface and front and rear walls, each wall having a longitudinally extending recess adjacent the bottom surface, a plurality of support members for a window unit, said support members being longitudinally spaced along the channel, each support member resting on the bottom surface of the channel and having front and rear longitudinally extending projections in snapping engagement in the recesses in the front and rear walls of the channel.

Each support member may have a flat upper surface with a transversely extending groove therein extending from a rear edge of the upper surface at least part way across the surface towards a front edge thereof. The transverse groove in the upper surface support member extends more than half way across the surface but terminates short of the front edge.

At least one of the support members may have a plate-like shim mounted thereon, the shim having a flat upper surface and a flat lower surface, said lower surface of the shim resting on the upper surface of the support member, and said flat lower surface of the shim having a transversely extending tongue in sliding engagement in the transversely extending groove in the upper surface of the support member.

Each shim may be a first shim and have a transversely extending groove in its upper surface extending from a rear edge thereof at least part way across the surface towards a front edge thereof, the window frame assembly also including a plurality of second shims, each second shim having a plate-like body with a flat upper surface and a flat lower surface, the lower surface of each second shim resting on the upper surface of each first shim, and said lower surface of each second shim having a transversely-extending tongue in sliding engagement in the transversely extending groove in the upper surface of the respective first shim.

Figure 1A:
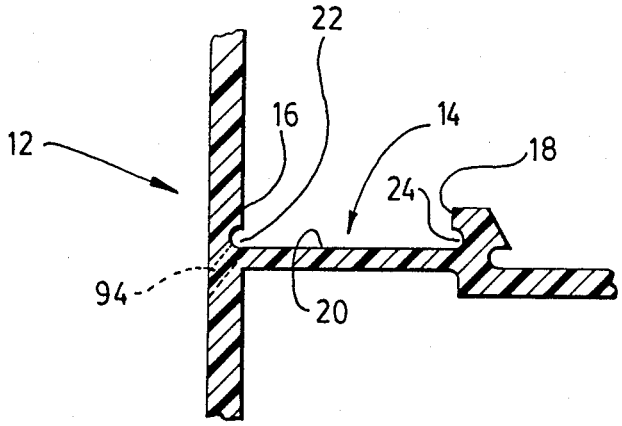
Figure 2:
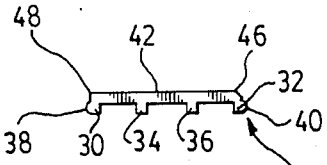
Figure 4:
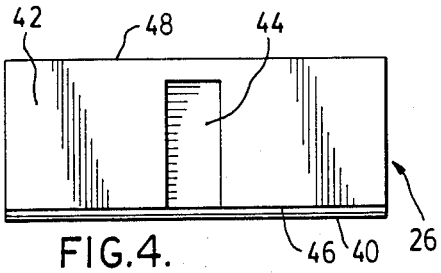
Figure 3:
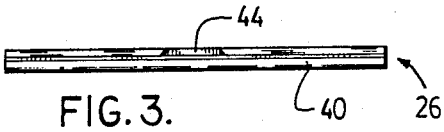
Figure 5:
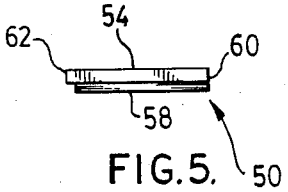
Figure 7:
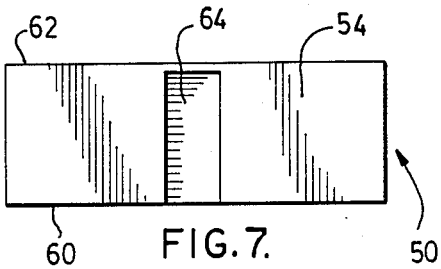
Figure 6:
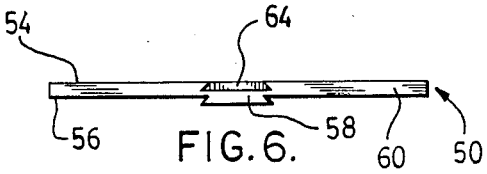
Figure 8:
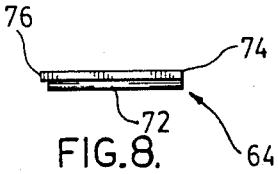
Figure 10:
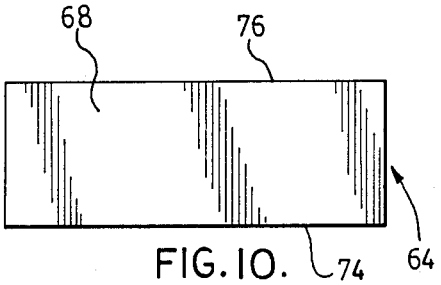
Figure 9:
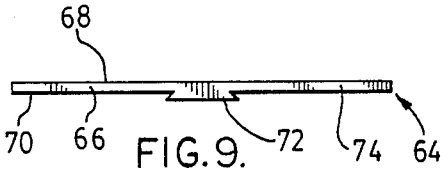
Figure 11:
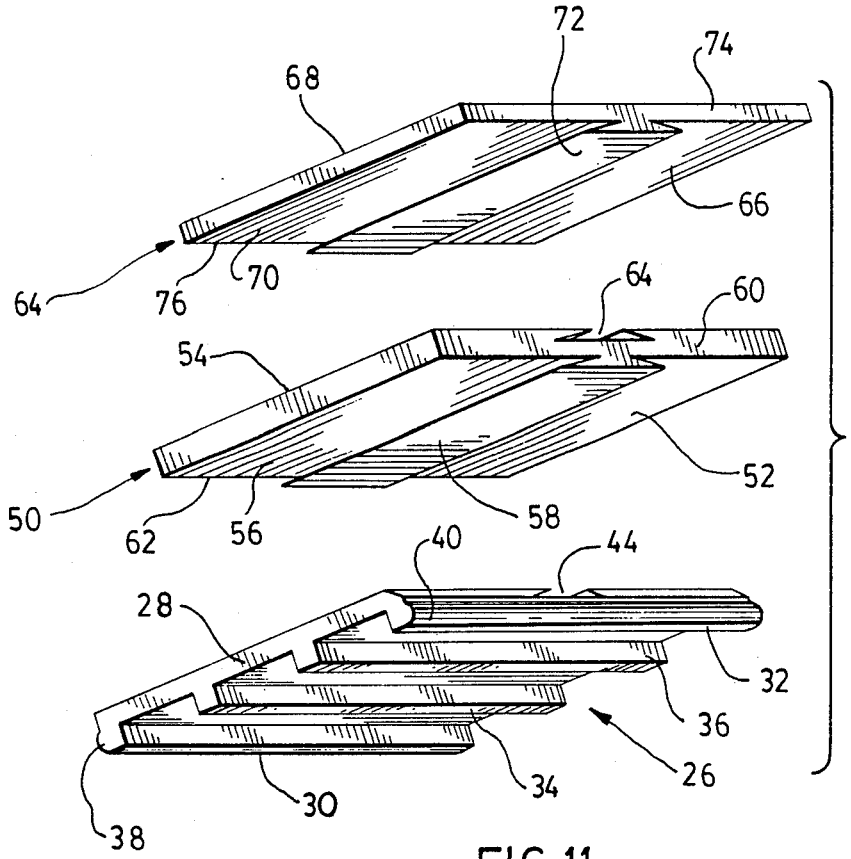
Figure 12:
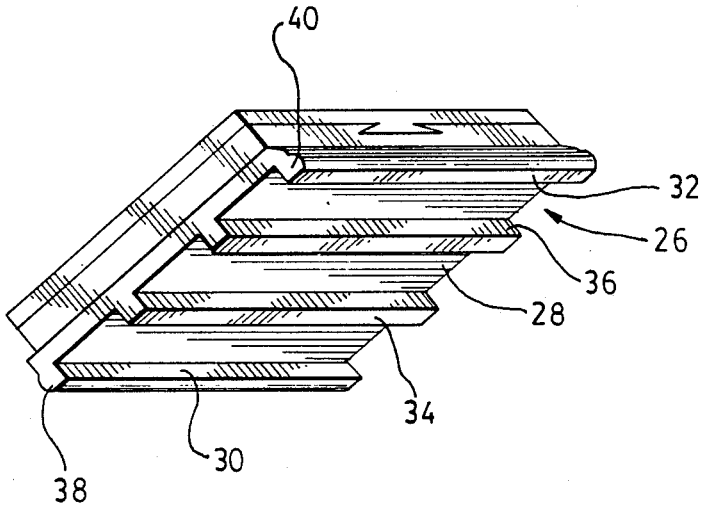

One embodiment of the present invention will now be described, by way of example, with reference to the accompanying drawings, of which:

FIG. 1 is a section view of part of a window frame assembly in accordance with the invention, FIG. 1A is a detailed view showing the channel of the frame member of FIG. 1, FIG. 2 is an end view of the support member, FIG. 3 is a rear view, FIG. 4 is a plan view, FIG. 5 is an end view of an intermediate shim, FIG. 6 is a rear view, FIG. 7 is a plan view, FIG. 8 is an end view of an upper shim, FIG. 9 is a rear view, FIG. 10 is a plan view, FIG. 11 is an exploded prospective view of the support member, intermediate shim and upper shim particularly showing the lower surfaces thereof, and FIG. 12 is a similar view of the support member, intermediate shim and upper shim in assembly.

Referring to the drawings, a window frame assembly includes a frame member 12 which typically is an aluminum or plastic extrusion and which has a longitudinally extending channel 4 with front and rear walls 6, 8 and a bottom surface 20 in known manner. In accordance with the invention, the front wall 16 has a longitudinally extending recess 22 adjacent the bottom surface 20, and the rear wall 18 has a longitudinally extending recess 24 adjacent the bottom surface 20. The remaining parts of the frame member 2 are conventional and will not be described further except where necessary to fully describe the invention. The frame member 2 may of course be a lower frame member, a side frame member or an upper frame member.

A series of support members 26 are positioned at suitable spaced intervals along the channel 14. Each support member 26 is of injection molded plastic and has a generally plate-like body 28 from which front and rear longitudinally extending ribs 30, 32 extend downwardly from the front and rear edges respectively of the body 28. A pair of transversely-spaced longitudinally-extending intermediate ribs 34, 36 extend downwardly from the lower surface of the body 28.

The front rib 30 has a longitudinally-extending projection 38 extending along its front surface, and the rear rib 32 has a longitudinally-extending projection 40 extending along its rear surface. The longitudinally-extending projections 38, 40 on the support member 26 and the longitudinally-extending recesses 22, 24 in the channel 14 of the base frame member 2 are shaped for snapping engagement.

The body 28 of each support member 26 has a flat upper surface 42 with a transversely-extending groove 44 of dovetail shape extending from the rear edge 46 of the body 28 nearly to its front edge 48.

An intermediate shim 50 has a plate-like body 52 with flat upper and lower surfaces 54, 56. The lower surface 56 has a transversely-extending tongue 58 of dovetail shape extending from the rear edge 60 nearly to the front edge 62. The upper surface 54 has a transverse groove 64 extending from the rear edge 60 nearly to the front edge 62.

An upper shim 64 has a plate-like body 66 with flat upper and lower surfaces 68, 70. The lower surface 70 has a transverse tongue 72 of dovetail shape extending from the rear edge 74 nearly to the front edge 76. The upper flat surface 68 is plain, i.e. ungrooved.

When installing a window unit 80 (see FIG. 1 ), a series of supports 26 are snapped into the channel 14 in the lower, side and upper frame members 2 at spaced intervals. Each support member 26 is installed by positioning the front projection 38 in the front groove 22 in the frame member 12 and then snapping the rear projection 40 into the rear recess 24, with the ribs 30, 34, 36, 32 of the support member 26 engaging the bottom surface 20 of the channel 14. Each support member 26 is thereby firmly secured in the channel 14.

The window unit 80 is of the conventional type with a pair of spaced window panes 82, 84 held in sealed spaced relationship by a sealed spacer assembly 86. In practice, it will usually be necessary to the window unit 80 by inserting one or more shims between the sealed spacer assembly 86 of the window unit 80 and the support member 26.

if one shim only is required, an upper shim 64 is used. The shim 64 is assembled with the support member 26 by sliding the tongue of the shim 64 into the groove 44 in the top of the support member 26 until the tongue 72 engages the end of the groove 44, whereupon the periphery of the shim 64 is flush with the periphery of the support member 26.

If an intermediate shim is required, an intermediate shim 50 is used. Intermediate shim 50 is assembled with the support member 26 in the same manner as described above in upper shim 64, and the shim 64 is then assembled with the intermediate shim 50, as indicated particularly in FIGS. 1 and 2 and as shown in FIG. 1. Further intermediate shims 50 can of course be used if necessary.

The lower frame member 12 is typically provided with drain holes 94 extending from the channel 14 through which moisture running down the window panes 82, 84 and seeping past the sealing arrangements 88, 90 can drain away.

The advantages of the present invention will be readily apparent from the foregoing description of a preferred embodiment. Other embodiments of the invention will also be readily apparent to a person skilled in the art, the scope of the invention being defined in the appended claims.

I claim:

1. A window frame assembly including:

a frame member having a longitudinally extending channel with a bottom surface and front and rear walls, each wall having a longitudinally extending recess adjacent the bottom surface, a plurality of support members for a window unit, said support members being longitudinally spaced along the channel, each support member resting on the bottom surface of the channel and having front and rear longitudinally extending projections in snapping engagement in the recesses in the front and rear walls of the channel.

2. A window frame assembly according to claim wherein each support member has a flat upper surface with a transversely extending groove therein extending from a rear edge of the upper surface at least part way across the surface towards a front edge thereof.

3. A window frame assembly according to claim 2 wherein the transverse groove in the upper surface of each support member extends more than half way across the surface but terminates short of the front edge.

4. A window frame assembly according to claim 2 wherein support member has a plate-like shim mounted thereon, the shim having a flat upper surface and a flat lower surface, said lower surface of the shim resting on the upper surface of the support member, and said flat lower surface of the shim having a transversely extending tongue in sliding engagement in the transversely extending groove in the upper surface of the support member.

5. A window frame assembly according to claim 4 wherein each shim is a first shim and has a transversely extending groove in its upper surface extending from a rear edge thereof at least part way across the surface towards a front edge thereof, the window frame assembly also including a plurality of second shims, each second shim having a plate-like body with a flat upper surface and a flat lower surface, the lower surface of each second shim resting on the upper surface of each first shim, and said lower surface of each second shim having a transversely-extending tongue in sliding engagement in the transversely extending groove in the upper surface of the respective first shim.

* * * * *